US005315799A

United States Patent [19]

Cullinan

[11] Patent Number: 5,315,799

[45] Date of Patent: May 31, 1994

[54] MUTLI-PANEL MOLDING ASSEMBLY FOR A BUILDING

[76] Inventor: James E. Cullinan, 2737 Welsford Rd., Columbus, Ohio 43221

[21] Appl. No.: 986,722

[22] Filed: Dec. 8, 1992

[51] Int. Cl.[5] ..... E04B 1/00; E04B 5/00; E04B 7/00

[52] U.S. Cl. ..... 52/288.1; 52/287.1; 52/94

[58] Field of Search ..... 52/94–96, 52/275–279, 281, 282, 287, 288, 288 MF

[56] References Cited

U.S. PATENT DOCUMENTS

| | | | |
|---|---|---|---|
| 388,286 | 8/1888 | Kinnear . | |
| 417,949 | 12/1889 | Sagendorph . | |
| 1,948,271 | 2/1934 | Kornbau | 189/46 |
| 2,075,676 | 3/1937 | Toney | 189/86 |
| 3,974,606 | 8/1976 | La Borde | 52/288 MF |
| 4,189,888 | 2/1980 | Blitzer, Jr. | 52/484 |
| 4,461,128 | 7/1984 | Knoebl | 52/94 |
| 4,592,176 | 6/1986 | Van Herpen | 52/96 |
| 4,672,781 | 6/1987 | Pichon | 52/94 |
| 4,696,136 | 9/1987 | Grewe | 52/288 MF |
| 4,949,520 | 8/1990 | Bear | 52/288 |
| 4,956,950 | 9/1990 | Hirose | 52/94 |
| 5,001,877 | 3/1991 | Edwards | 52/288 |

*Primary Examiner*—Neill R. Wilson

*Attorney, Agent, or Firm*—Porter, Wright, Morris & Arthur

[57] ABSTRACT

Extruded aluminum alloy base, intermediate and top panels and a decorative plastic insert are provided. One marginal portion of the base panel is mounted on a support member on a building. An opposing marginal portion on the base panel is formed with a coupling member and with a perpendicular flange. An adjoining marginal portion on the intermediate panel is formed with a member-receiving channel and a perpendicular ledge. An opposing marginal portion on the intermediate panel is formed with a coupling member and with a perpendicular ledge. An adjoining marginal portion on the top panel is formed with a member-receiving channel and with a perpendicular flange. An opposing marginal portion of the top panel is adapted to be mounted on the support member on the building. The relatively adjoining flanges and ledges on the base, intermediate and top panels are adapted to receive a plurality of machine screws. Relatively spaced apart flanges on the decorative insert are received in an insert-receiving opening defined by the intersection of the coupling member on the base panel and the member-receiving channel on the intermediate panel and in a longitudinally extending channel-form protuberance on the base panel.

10 Claims, 2 Drawing Sheets

MUTLI-PANEL MOLDING ASSEMBLY FOR A BUILDING

BACKGROUND OF THE INVENTION

The present invention is concerned generally with decorative or protective moldings or trim panels for buildings, and more particularly with multi-panel molding or trim assemblies.

Exterior crown moldings are intended to cover and protect relatively adjoining portions of roof and wall structures and joints therebetween without providing support to such structures. Ideally, such moldings impart an aesthetically pleasing appearance to the building. In high-traffic commercial applications, such as fast food restaurants, the crown moldings need to be strong, durable, non-distorting, inexpensive, easily installed and pleasing to the eye.

In an effort to meet the foregoing criteria, multi-panel or multi-component molding assemblies have been devised. Unfortunately, conventional assemblies are susceptible to alignment problems which, if they occur, substantially diminish the protective and decorative functions of these structures. In particular, exterior elements of one panel may not align precisely with the corresponding exterior elements of an adjoining panel. In addition, the panels may fit together poorly at joints, resulting in unsightly gaps between panels. Even when precise alignment and good fit of panel joints are achieved initially, distortion of one panel relative to another over a period of years may result in misalignment of and gaps between panels.

In the past, multi-panel molding assemblies have attempted to solve the fit and alignment problems by providing means for covering the joints between the panels. In effect, the molding assembly was provided with its own molding or trim pieces. Moldings employing such cover means have a visually fragmented appearance rather than a smooth, unbroken line and may require greater labor and material costs than simpler designs.

Another problem confronting the inventor was the difficulty of fabricating a strong, durable and non-distorting exterior molding while at the same time incorporating desired decorative elements. Moldings provided with relatively ornate elements, such as dentils, were expensive to manufacture. Likewise, the addition or modification of a decorative element to a molding beyond superficial changes in surface finish generally required costly, labor-intensive carpentry or machining. Frequently, the decorative elements were integrally formed in the molding, so its appearance could not be altered without replacing it entirely. Such reconstruction was disruptive to activities in and around the building on which the molding was installed, particularly when the building was a high-traffic commercial installation, such as a fast food restaurant.

Thus, the present inventor was faced with the problems of fabricating a strong, easily assembled and installed molding that maintained a virtually seamless appearance over the years and that incorporated one or more decorative elements without undue expense.

SUMMARY AND OBJECTS OF THE INVENTION

A multi-panel molding assembly according to the present invention basically comprises at least two elongated, unitary panels, one or more components for securing the panels together and a decorative insert. One of the panels has a longitudinally extending marginal portion formed with a coupling member. The other panel has a longitudinally extending marginal portion formed with a member-receiving channel. The coupling member and the member-receiving channel are adapted to define an insert-receiving opening therebetween. The panel securing component or components are adapted to secure the marginal portion of the panels together. The elongated decorative insert has a longitudinally extending panel-engaging portion adapted to be mounted in the insert-receiving opening defined by the coupling member and the member-receiving channel upon joining the marginal portions of said panels together.

The primary object of the present invention is to provide a durable, readily installed molding assembly which imparts a finished, decorative appearance to a building without undue expense. Another object of the present molding assembly is to accommodate limited dimensional irregularities in the building supporting member or members which it covers. A further object is to provide a molding assembly adapted to readily receive a decorative insert thereon. These and additional objects and advantages of the present invention may be more readily perceived and understood in view of the following drawings and detailed description.

DETAILED DESCRIPTION OF THE PREFERRED EMBODIMENT

Figure 1:
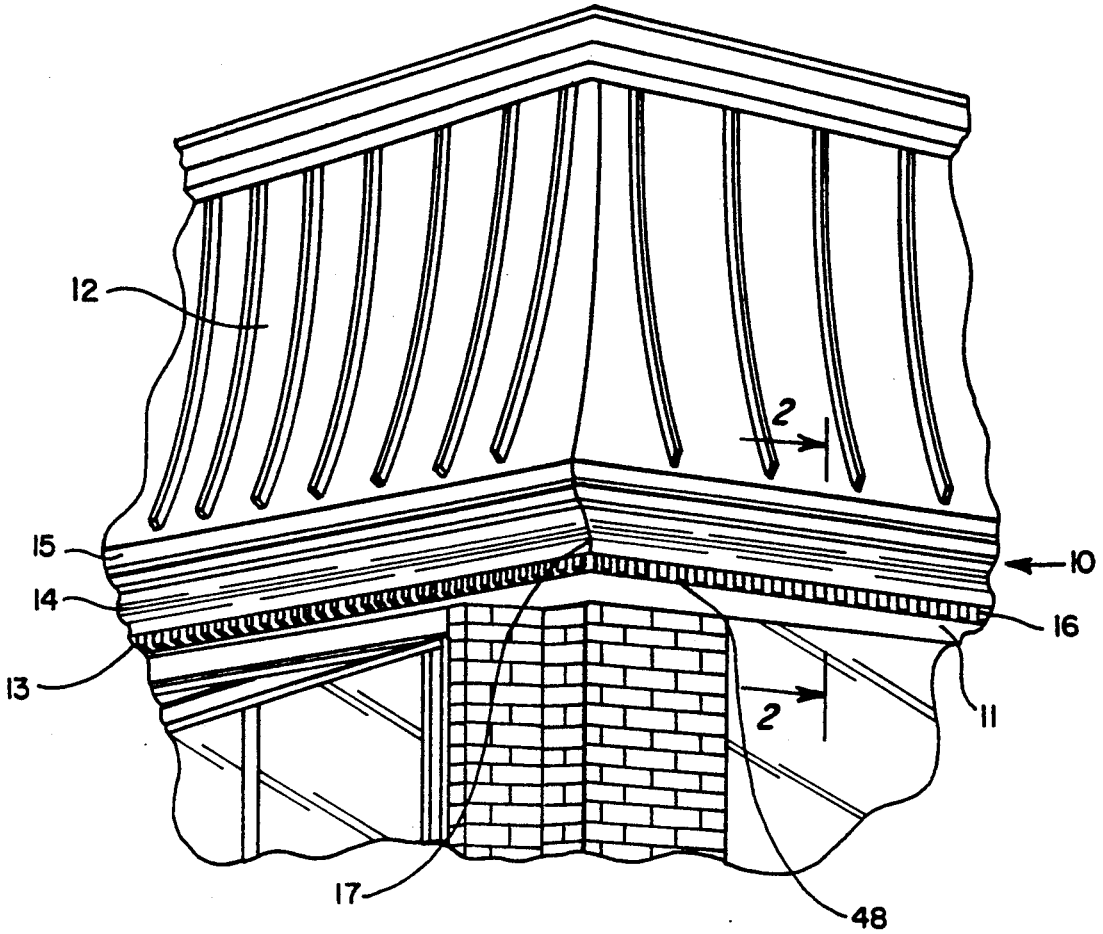
FIG. 1 is a fragmentary perspective view of a portion of a building upon which a molding assembly according to the present invention, as well as relatively adjoining fascia and soffit elements are installed.

As illustrated in FIG. 1, a plurality of crown molding assemblies, generally designated 10, according to the present invention, are arranged in abutting relation to one another to form a decorative and protective transition member which is positioned between horizontally extending soffits or eaves 11 and generally vertically extending, weatherable mansard roof panels 12. Each of the present molding assemblies 10 is formed with longitudinally co-extensive, horizontally extending base, intermediate and top panels 13, 14 and 15, respectively, and with a longitudinally co-extensive decorative dentil insert 16. A vertical joint or seam 17 between angularly adjoining molding assemblies 10 is formed by mitering the abutting ends of the panels 13–15 and by caulking or otherwise weatherproofing the seam 17 therebetween.

Figure 2:
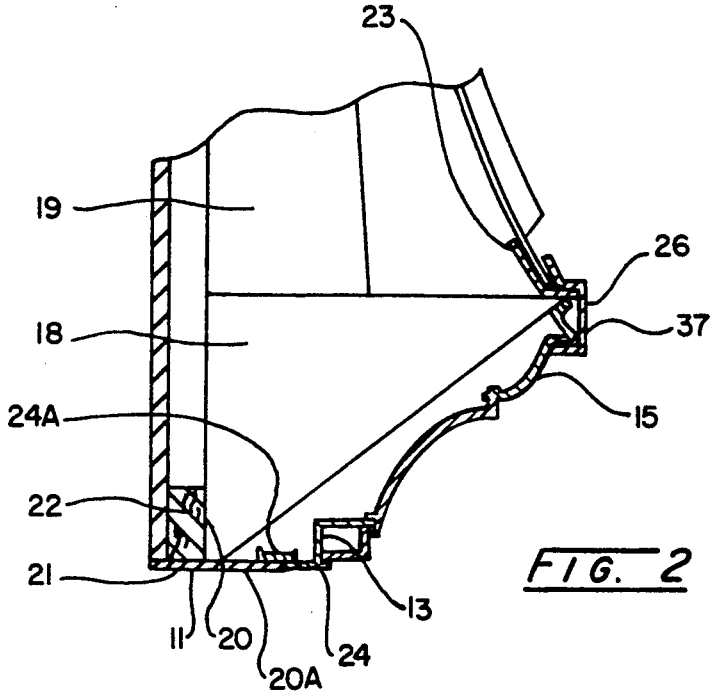
FIG. 2 is a vertical sectional view taken along line 2—2 of FIG. 1 and particularly illustrates a preferred manner in which the present molding assembly is mounted upon the building.

As indicated in FIG. 2, the present molding assembly 10 is disposed in covering relation to and is supported by diagonally outwardly projecting triangular base members 18 provided on a plurality of relatively spaced apart vertically extending trusses 19. The soffit 11 is defined by an outwardly projecting ledge 20A on a generally L-shaped bottom stringer 20 and by flashing 21. The bottom stringer 20, flashing 21 and lower edge of the truss bases 18 are mounted on a horizontally extending frame member 22. A roof panel retaining bracket 23 is mounted on and extends horizontally between upper edge portions of the triangular truss bases 18.

Figures 3, 4, 5:
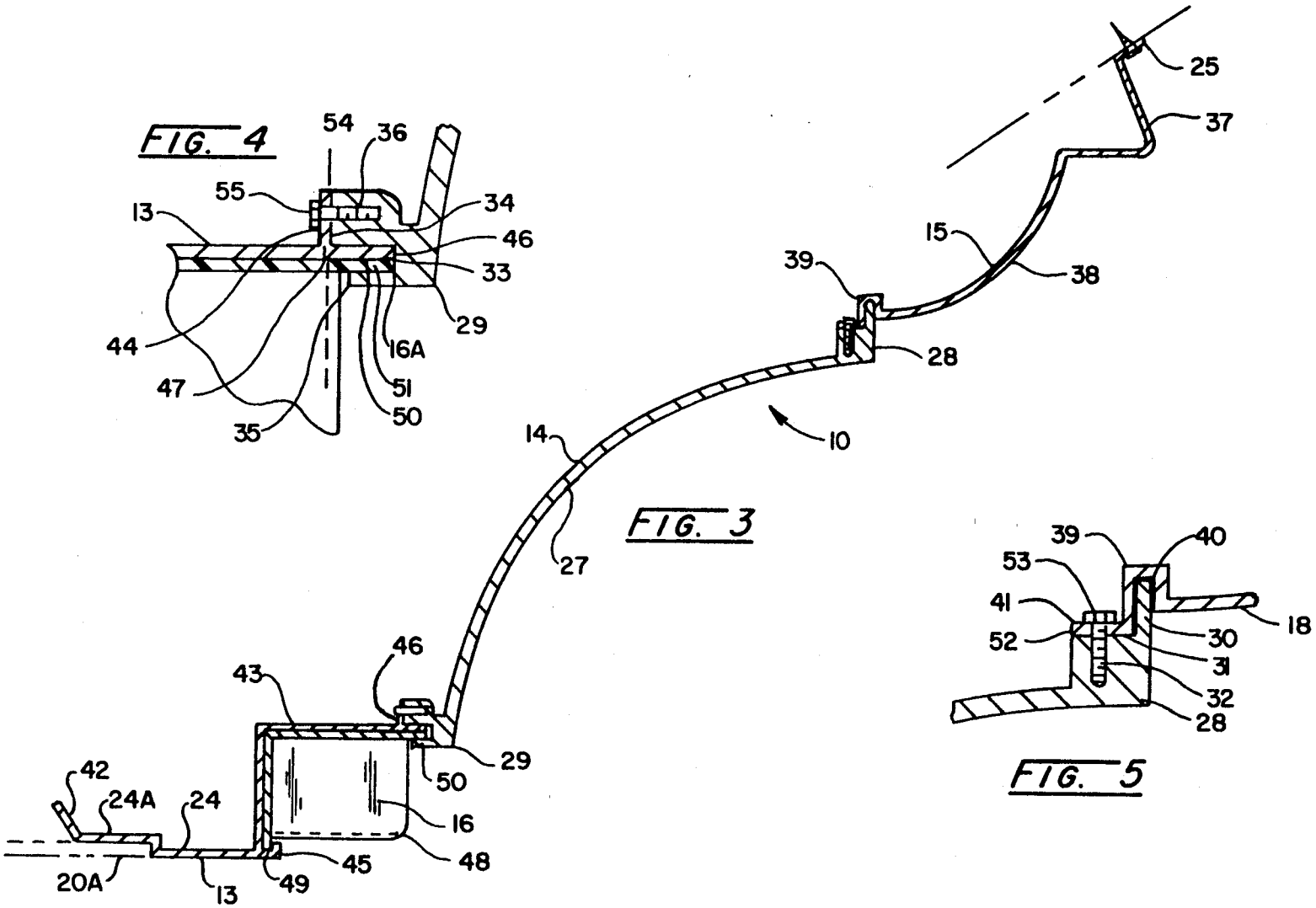
FIG. 3 is an enlarged vertical sectional view of the molding assembly illustrated in FIG. 2.
FIG. 4 is an enlarged, fragmentary detail view of a joint between base and intermediate panels of the present molding assembly and an edge of a synthetic resin insert provided thereon.
FIG. 5 is an enlarged, fragmentary detail view of a joint between intermediate and top panels of the present molding assembly.

As best indicated in FIG. 3, a leg 24 is provided on the molding base panel 13 and is formed with a relatively offset portion 24A which is carried on the outwardly projecting ledge 20A of the bottom stringer 20. An upper terminal lip or marginal flange 25 on the top panel 15 is secured by a conventional fastener to the triangular truss base 18 adjacent to its upper apex. As indicated in FIG. 2, a horizontally extending, channel-formed flashing member 26 extends between and is secured to the top panel 15 and to the roof panel retaining bracket 23. The base, intermediate and top panels 13–15 of the present crown molding assembly 10 are each integrally or unitarily formed as elongated aluminum alloy extrusions. As best indicated in FIGS. 3–5 and as described in some detail below, the aluminum alloy panels 13–15 differ from one another in shape and size.

The intermediate panel 14 is formed with a generally arcuate body portion 27 and with relatively opposing, longitudinally co-extensive upper and lower marginal portions 28 and 29, respectively. As indicated in FIG. 5, the upper marginal portion 28 is formed with a coupling member or ridge 30, a flange-supporting ledge 31 extending perpendicularly to a base portion of the ridge 30, and a fastener-receiving groove 32 projecting inwardly from the supporting ledge 31. As best indicated in FIG. 4, the lower marginal portion 29 is unitarily formed with a coupling member-receiving channel 33, a flange-supporting surface or ledge 34 extending perpendicularly to an open end of the channel 33, an end wall 35 formed on the opposite side of the channel 33 from the flange supporting surface 34, and a fastener-receiving groove 36 projecting inwardly from the supporting ledge 34 in spaced, parallel relation to the channel 33. Preferably, the end wall 35 is disposed slightly inwardly on the lower marginal portion 29 relative to the flange supporting ledge 34. Each of the foregoing features of the upper and lower marginal portions 28, 29 extend, preferably, the entire length of the respective marginal portion upon which it is formed.

As indicated in FIG. 3, the top panel 15 is integrally and unitarily formed with the aforementioned truss-engaging marginal flange 25, a generally V-shaped leg 37 extending downwardly therefrom, an arcuate body portion 38 connected to the lower end of the leg 37 and a panel-mounting portion, generally designated 39, defining a lower marginal portion of the top panel 15. As indicated in FIG. 2, the generally horizontally disposed portion of the V-shaped leg 37 serves as a mounting surface for the flashing 26. As best indicated in FIG. 5, the panel-mounting marginal portion 39 of the top panel 15 is integrally or unitarily formed with a ridge-receiving groove 40 and with a fastener-receiving, ledge-engaging flange 41. All of the aforementioned features of the top panel 15 are preferably longitudinally co-extensive with one another.

As further indicated in FIG. 3, the base panel 13 is a bracket-like structure formed with an angularly disposed marginal foot 42, the previously mentioned offset leg 24, 24A, a generally right-angular body portion 43 and a panel-mounting portion, generally designated 44, which defines an upper marginal portion of the base panel 13. In addition, an insert-receiving channel-form protuberance 45 extends outwardly from the external surface of the base panel 13 adjacent to the juncture of the leg 24 and the body 43. As best indicated in FIG. 4, the panel mounting marginal portion 44 of the base panel 13 is integrally or unitarily formed with a coupling member 46 having an enlarged lip 46A and with a fastener-receiving anchoring flange 47 projecting perpendicularly from a base portion of the coupling member 46. All of the foregoing features of the base panel 13 are preferably longitudinally co-extensive with one another.

As previously indicated in connection with FIG. 1, the elongated dentil-shaped decorative insert 16 extends longitudinally along a lower portion of the present molding assembly 10. Preferably, the decorative insert 16 is vacuum molded from synthetic resin material such as ABS (acrylonitrile-butadiene-styrenecopolymer) and is provided in lengths (e.g., 16.5 feet or 5.029 meters) substantially equal to the aluminum alloy panels 13–15. The decorative insert 16 consists of a plurality of generally equally spaced apart hollow cubes or dentils 48 projecting outwardly from a surrounding, generally L-shaped base having openings corresponding in size and position to the outwardly projecting dentils 48. Alternatively, the insert may be vacuum molded to provide a series of alternating egg and dart projections or other desired shapes. As best indicated in FIG. 3, the L-shaped insert base includes a pair of relatively spaced apart, perpendicularly related mounting flanges 49, 50 projecting outwardly from the dentils 48. Preferably, the mounting flanges 49, 50 extend continuously along the entire length of the insert 16. The insert-receiving channel-form protuberance 45 formed on a lower portion of the base panel body 43 slidably receives one of the insert flanges 49. As best indicated in FIG. 4, the other insert flange 50 is slidably received in a longitudinally extending opening 51 which is defined by the coupling member body 46, lip portion 46A, and the inner wall of the channel 33 adjacent to the end wall 35. Preferably, the foregoing end wall 35 is slightly recessed relative to the flange-supporting surface 34 to facilitate the positioning of the insert flange 50 within the opening 51.

As indicated in FIGS. 3 and 5, the upper marginal portion 28 of the intermediate panel 14 and the lower marginal portion 39 of the top panel 15 are rigidly fastened together. In this regard, the relatively adjoining components are sized and shaped so that the coupling member or ridge 30 may be inserted into and fit snugly within the ridge-receiving groove 40. Preferably, the ridge 30 possesses a substantially uniform thickness and a slightly tapered or rounded end. With the foregoing ridge 30 fully received in the groove 40, the ledge-engaging flange 41 of the top panel 15 is seated on the ledge 31 of the intermediate panel 14. Advantageously, the foregoing relatively adjoining components formed on the marginal portions 28 and 39 of the intermediate and top panels, respectively, are inset relative to the external surfaces of said panels. In this manner, a substantially seamless external appearance is presented at the subject junction 28, 39. A plurality of spaced apart fastener-receiving bores 52 (FIG. 5) extend through and are disposed along the length of the flange 41, and a plurality of machine screws 53 or other fasteners project through the bores 52 in the top panel 15 and tightly grip the walls of the fastener-receiving groove 32 in the intermediate panel 14.

Likewise, as indicated in FIGS. 3 and 4, the lower marginal portion 29 of the intermediate panel 14 and the upper marginal portion 44 of the base panel 13 are rigidly secured together. In this regard, the relatively enjoining components are sized and shaped so that the coupling member lip 46A may be inserted into and fit snugly within the receiving channel 33, while the coupling member body 46 is sufficiently thinner than the channel 33 to provide the insert-receiving opening 51 therebetween. With the foregoing lip 46A fully received in the channel 33, the fastener-supporting flange 47 of the base panel 13 is seated on the flange-engaging ledge 34 of the intermediate panel 14, and the insert-receiving opening 51 is provided between the coupling member body 46 of the base panel 13 and the channel wall of the intermediate panel 14. Advantageously, the foregoing relatively adjoining components formed on the marginal portions 28 and 29 of the intermediate and base panels, respectively, are inset relative to the external surfaces of said panels. In this manner, a substantially seamless external appearance is presented at the subject junction 29, 44. A plurality of spaced apart fastener-receiving bores 54 (FIG. 4) extend through and are disposed along the length of the flange 34, and a plurality of machine screws 55 or other fasteners project through the bores 54 in the base panel 13 and tightly grip the walls of the fastener-receiving groove 36 in the intermediate panel.

Advantageously, the close fitting relationship between the enlarged coupling member lip 46A and the coupling member-receiving channel 33, as well as the combined anchoring effect of the fasteners 55, the flange 47 and the ledge 34 prevent the insert-receiving opening 51 from collapsing. As a result, the insert flange 50 is capable of sliding movement within the insert-receiving opening 51. Accordingly, once the extruded aluminum alloy panels 13–15 have been assembled in the above-described manner, the longitudinally coextensive molded plastic insert 16 is attached by aligning the flanges 49, 50 at one end of the insert with the respective channel-form protuberance 45 and opening 51 at one end of the attached base and intermediate panels and by sliding the insert between the protuberance 45 and the opening 51 the entire length of the insert. As a result of the use of relatively inexpensive, vacuum molded plastic to form the insert and the ease with which the insert may be installed, it would be relatively simple and inexpensive to replace the present dentil insert 16 with an insert having an egg and dart shape or other configuration.

It is frequently necessary to cut one or more of the present molding assemblies 10 to a suitable length prior to installing it on a building. Preferably, a reciprocating saw or jigsaw equipped with a suitable metal cutting blade is employed for this purpose. Prior to cutting, however, the Plastic dentil insert 16 should be removed and separately cut to a length corresponding to the desired length of the panels 13–15. Abutting ends of relatively adjoining molding assemblies 10 are preferably mitered to present a continuous appearance, and weatherproof caulking may be applied to the joint between the abutting ends once the adjoining molding assemblies have been installed.

In the foregoing manner, the present invention provides a molding assembly which is at once durable, readily and simply produced and installed, and pleasing to the eye.

While a single preferred embodiment of the present molding assembly has been illustrated and described in some detail, the foregoing specification is not intended to unduly limit the spirit or gist of the invention, nor the scope of the following claims.

I claim:

1. An axially elongated molding assembly exposed to view and adapted to be mounted on at least one supporting member disposed on a building, said molding assembly comprising:

(a) at least two axially extending unitary panels, one of said panels being adapted to be mounted on the supporting member and having (i) an axially extending marginal portion formed with a first coupling member and (ii) a first axially extending insert-receiving opening spaced from the first coupling member, the other of said panels having (i) an axially extending marginal portion formed with a second coupling member, and (ii) a transverse web portion;

(b) means for securing the first coupling member of said one panel to the second coupling member of said other panel, with the transverse web portion of said other panel projecting away from said one panel; and (c) an axially elongated decorative insert having an axially extending panel-engaging portion adapted to be mounted in the first axially extending insert-receiving opening on said one panel, said decorative insert being disposed in overlying relation to at least said one panel, said transverse web portion of said other panel being exposed to view.

2. The molding assembly according to claim 1, wherein the means for securing the first coupling member of said one panel to the second coupling member of said other panel comprises a longitudinally extending flange formed on the marginal portion of said one panel adjacent to and generally perpendicular to the first coupling member thereon and a longitudinally extending ledge formed on the marginal portion of said other panel adjacent to and generally perpendicular to the second coupling member thereon, said flange and said ledge being adapted to receive at least one fastener.

3. The molding assembly according to claim 1, wherein the second coupling member on said other panel is formed with a member-receiving channel and wherein the first coupling member on said one panel and the member-receiving channel on said other panel are adapted to define a second insert-receiving opening therebetween when joined together.

4. The molding assembly according to claim 3, wherein the first coupling member on said one panel is formed with a body portion which defines one side of the second insert-receiving opening and with a relatively enlarged terminal lip portion adapted to fit snugly within the member-receiving channel of said other panel.

5. The molding assembly according to claim 2, wherein the decorative insert is formed with a pair of relatively spaced apart axially extending panel-engaging flanges, one of said flanges being removably received in the first insert-receiving opening of said one panel and the other of said flanges being removably received in the second insert-receiving channel.

6. A molding assembly adapted to be mounted on at least one supporting member disposed on a building, said molding assembly comprising:

a) an elongated base panel having an insert-receiving channel-form protuberance and relatively opposing longitudinally extending marginal portions, one of said marginal portions being adapted to engage the supporting member on the building and the other of said marginal portions being formed with a coupling member;

b) an elongated intermediate panel having relatively opposing longitudinally extending marginal portions, one of said marginal portions being formed with a member-receiving channel adapted to receive the coupling member on the base panel and the other of said marginal portions being formed with a coupling member, said coupling member on the base panel and said member-receiving channel on the intermediate panel being adapted to define an insert-receiving opening therebetween;

c) means for securing the coupling member on the base panel to the member-receiving channel on the intermediate panel;

d) an elongated decorative insert having a pair of relatively spaced apart, longitudinally extending panel-engaging flanges, one of said flanges being adapted to be mounted in the insert-receiving opening defined by the coupling member on the base panel and the member-receiving channel on the intermediate panel and the other of said flanges being adapted to be mounted in the insert-receiving channel-form protuberance on the base panel;

e) an elongated top panel having relatively opposing longitudinally extending marginal portions, one of said marginal portions being formed with a member-receiving channel adapted to receive the coupling member on the intermediate panel and the other of said marginal portions being adapted to engage the supporting member on the building; and f) means for securing the coupling member on the intermediate panel to the member-receiving channel on the top panel.

7. The molding assembly according to claim 5, wherein the coupling member on the base panel is formed with a body portion which defines one side of the insert-receiving opening and with a relatively enlarged terminal lip portion adapted to fit snugly within the member-receiving channel of the intermediate panel.

8. The molding assembly according to claim 5, wherein the coupling member on the intermediate panel is generally uniform in thickness and is adapted to fit snugly within the member-receiving channel on the top panel.

9. The molding assembly according to claim 5, wherein the means for securing the coupling member on the base panel to the member-receiving channel on the intermediate panel comprises a longitudinally extending flange formed on one of the marginal portions of the base panel adjacent to and generally perpendicularly to the coupling member thereon, and a longitudinally extending ledge formed on one of the marginal portions of the intermediate panel adjacent to and generally perpendicular to the member-receiving channel thereon, said flange and said ledge being adapted to receive at least one fastener.

10. The molding assembly according to claim 5, wherein the means for securing the coupling member on the intermediate panel to the member-receiving channel on the top panel comprises a longitudinally extending flange formed on one of the marginal portions of the top panel adjacent to and generally perpendicular to the member-receiving channel thereon, and a longitudinally extending ledge formed on one of the marginal portions of the intermediate panel adjacent to and generally perpendicular to the coupling member thereon, said flange and said ledge being adapted to receive at least one fastener.

* * * * *